US006638167B1

(12) United States Patent
Sawyer et al.

(10) Patent No.: US 6,638,167 B1
(45) **Date of Patent: *Oct. 28, 2003**

(54) ELECTRONIC SYSTEM AND METHOD FOR OPERATING AN AUXILIARY INCENTIVE GAME

(75) Inventors: Thomas E. Sawyer, Idaho, CO (US); Tony A. Cranford, Morrison, CO (US); Réal Bérubé , St-jean-Chrysostome (CA); Marcel Huard, St-Romuald (CA)

(73) Assignee: B.C.D. Mécanique Ltée, Québec (CA)

( * ) Notice: Subject to any disclaimer, the term of this patent is extended or adjusted under 35 U.S.C. 154(b) by 0 days.

This patent is subject to a terminal disclaimer.

(21) Appl. No.: 09/686,799

(22) Filed: Oct. 12, 2000

Related U.S. Application Data

(63) Continuation of application No. 09/296,408, filed on Apr. 23, 1999, now Pat. No. 6,179,710, which is a continuation of application No. PCT/IB98/01322, filed on Aug. 25, 1998, which is a continuation-in-part of application No. 08/918,944, filed on Aug. 25, 1997.

(51) Int. Cl.[7] ..... A63F 9/24

(52) U.S. Cl. ..... 463/26; 463/42

(58) Field of Search ..... 463/1, 9, 11–12, 463/16, 20, 25–30, 35, 36, 40, 42; 273/309, 292, 293, 143 R, 138.1, 138.2, 139, 118 R, 121 B; 340/323 R

(56) References Cited

U.S. PATENT DOCUMENTS

| | | | |
|---|---|---|---|
| 5,586,766 A | | 12/1996 | Forte et al. |
| 5,707,285 A | | 1/1998 | Place et al. |
| 5,743,800 A | | 4/1998 | Huard et al. |
| 5,848,932 A | | 12/1998 | Adams |
| 6,179,710 B1 | * | 1/2001 | Sawyer et al. |

FOREIGN PATENT DOCUMENTS

| | | |
|---|---|---|
| GB | 2201821 | 9/1988 |

* cited by examiner

*Primary Examiner*—Mark Sager
(74) *Attorney, Agent, or Firm*—Birch, Stewart, Kolasch & Birch, LLP

(57) ABSTRACT

An apparatus for controlling or displaying the progress of each player playing in an auxiliary incentive game played simultaneously with a primary casino table game. The auxiliary game allows each player to receive bonus points during the course of playing the primary game, and each player eligible to receive a prize only after accumulating a predetermined number of bonus points. A bonus point display displays the number of bonus points received by each player at the gaming table. A controller is connected to the bonus point display and has a first unit for causing the display to display an incremented number of bonus points received by each player and a second unit for causing the display to reset and display a starting number of points in response to the number of bonus points received by the associated player reaching a predetermined number of bonus points.

57 Claims, 4 Drawing Sheets

ELECTRONIC SYSTEM AND METHOD FOR OPERATING AN AUXILIARY INCENTIVE GAME

This application is a Continuation of application Ser. No. 09/296,408 filed on Apr. 23, 1999 and issued as U.S. Pat. No. 6,179,710 on Jan. 30, 2001. U.S. Pat. No. 6,179,710 is a Continuation of application Ser. No. PCT/IB98/01322 filed on Aug. 25, 1998 which designated the U.S. application Ser. No. PCT/IB98/01322 which is a CIP and claimed priority under 35 U.S.C. §120 of application Ser. No. 08/918,944 filed Aug. 25, 1997, now pending. The entire contents of application Ser. No. 09/296,408, application Ser. No. 08/918,944 and PCT/IB98/01322 are hereby incorporated by reference.

BACKGROUND OF THE INVENTION

Casino table games such as craps, roulette, poker, blackjack or other card games are highly profitable to casinos, particularly because the odds associated with such gambling games favor the casino. In order to maximize the profit generated by each table, it is desirable to not only attract a large number of players to the table but to also keep the players playing at the table for an extended period of time. In essence, while a player may occasionally stop at a table to place several wagers, a casino is most likely to make a profit from a player who stays at a single table over the course of several hours because it is unlikely that such a player will be able to "beat the odds" over the long run.

Thus, casinos often add extra incentives (e.g., complimentary food and beverages) to keep players at the gaming tables for extended periods of time. However, since all casinos typically offer the same extra incentives, it is not uncommon for players to "try their luck" at a number of different tables or even at a number of different casinos within a single gambling session. For example, if a player is losing money at a particular table (e.g., a blackjack table), or if the player feels that a particular table (or a particular dealer) is unlucky, that player may leave the table and, in some instances, may leave the casino altogether to gamble elsewhere. Of course, during the time that the player is surveying different tables or different casinos, that player is not gambling and the casino is not profiting from that player.

Thus, casinos not only have an interest in attracting players to their table games, they also have an interest in keeping a player at his or her seat for as long as possible. In addition to complimentary items such as beverages, which may help to keep gamblers in the casino but will not necessarily promote continuous wagering at a specific table, casinos may wish to provide an extra incentive to players who play for extended periods of time at a single table. Such an added incentive may be an auxiliary incentive game which is played simultaneously with the primary game, while not interfering with the primary game.

The auxiliary game preferably offers its own set of prizes separate from any rewards or losses which the player may experience within the primary game. Additionally, the auxiliary game preferably rewards all players who remain at the table, regardless of whether the players are winning or losing at the primary game. The auxiliary game simply provides players with an opportunity for additional rewards if the player remains at the table for a sufficient amount of time to complete or "win" the auxiliary game. However, the pace of the auxiliary game is preferably much slower than the pace of the primary game so that a player must continue to play the primary game for a number of hours without interruption before being afforded an opportunity to complete or win the auxiliary game. In this manner, the auxiliary game serves its purpose of keeping players at the gaming table for long periods, even if the player may be losing money at the primary table game.

An auxiliary prize gaming system is disclosed in U.S. Pat. No. 5,743,800 to Huard et al., the specification of which is hereby incorporated by reference. In Huard et al., the auxiliary prize game includes random selection means for selecting at random the prize amount to be awarded, for selecting at random the matching gaming symbols or for randomly selecting a player position. The auxiliary prize may be awarded based on a player's fulfilling of one or more eligibility conditions, such as matching and player position selection.

Another example of such an auxiliary game which is played simultaneously with blackjack as the primary game is Ten Stix 21™. Ten Stix 21™ is played in the same format as blackjack where all players attempt to beat the dealer's hand without going over 21. The primary difference between Ten Stix 21™ and standard blackjack is that a bonus card is substituted for one card in each deck of cards. "Bonus points" may be awarded for each of the bonus cards collected by the players during the course of multiple consecutive blackjack hands. Once a player has collected a predetermined number of bonus points, the player is awarded a prize by the casino as a bonus gift. This bonus prize thus provides the added incentive for players to stay at the blackjack table, regardless of whether the player is winning or losing while playing blackjack.

The bonus cards used within Ten Stix 2™ preferably replace the ten of clubs within each card deck so that, for example, a six-deck shoe of cards would contain six bonus cards but no ten of clubs. During the normal course of a blackjack hand, each bonus card carries the value of ten and can be utilized by both a player or the dealer as a ten. However, the players have the option of either keeping the bonus card and playing it as a ten or trading the bonus card into the dealer for the next card out of the shoe. If the player opts to trade in the bonus card, the player receives a bonus point toward completion of the auxiliary game. However, the bonus point does not impact the player's current blackjack hand. Rather, upon trading in the bonus card and receiving a replacement card from the dealer, the blackjack hand continues in a normal manner. On the other hand, if the player opts to keep the bonus card, play continues normally with the bonus card being assigned a value of ten points within the player's hand.

To prevent a player who receives the bonus card from gaining an unfair advantage over other players during the course of the blackjack hand, a player will not be allowed to trade in the bonus card if the bonus card "busts" the player's hand (i.e., if the bonus card's ten-point value would cause the player's hand to exceed twenty-one points). Thus, in those instances, the bonus card will automatically be accorded its ten-point value and the player will not receive a bonus point for being dealt the bonus card. Additionally, the dealer does not have the option to trade in a bonus card, and thus a bonus card dealt to the dealer will count the same as a ten card.

To complete or win the auxiliary incentive game within Ten Stix 21™, a player must accumulate ten bonus points at one sitting at the same table. In essence, a player starts with zero points when he or she first sits down at a Ten Stix 21™ table and receives a single bonus point for each bonus card traded in to the dealer. When the player trades in a tenth bonus card, the player completes or wins the auxiliary game and is awarded the prize by the casino.

However, the bonus points accumulated by a player over the course of a number of blackjack hands may not be carried away by the player to another table nor may the player save or carry over accumulated bonus points for use in subsequent sessions at the same table. Additionally, a first player's bonus points may not be transferred to another player at the table or carried over to a subsequent player who takes the first player's spot at the table. In this manner, a player is encouraged to stay at the blackjack table for extended periods of time until the player has accumulated the ten bonus points required to win the auxiliary game and thus the casino prize. In particular, the Ten Stix 21™ version of blackjack tends to increase the duration of a player's stay at the blackjack table because the player's determination to win the bonus prize will typically increase as he or she continues to accumulate bonus points. In fact, a player may continue to play Ten Stix 21™ for hours after he or she would normally have left a conventional blackjack table due to the belief that he or she will eventually win the bonus prize.

The prior Ten Stix 21™ game required the dealers to physically trade a player's bonus card for an object such as special chip known as a "lammer." These lammers are then displayed by each player at a designated spot on the game table next to the player's position. Once a player accumulated ten lammers by trading in ten bonus cards in one sitting at the Ten Stix 21™ table, the player then turned the lammers into the dealer and collected the bonus prize offered by the casino. Of course, as noted above, a player was not allowed to transfer or trade the lammers to other players at the table, nor was a player allowed to take the lammers if the player left the table prior to accumulating ten lammers and claiming the bonus prize.

However, due to the tangible nature of the lammers, it was often difficult to police the players' conduct and enforce the above rules, particularly at a busy table where a large number of players may be entering and leaving the game. For example, a player who accumulates one or more lammers but who does not have sufficient funds to continue playing blackjack may attempt to surreptitiously transfer the lammers to another player or leave the table with the lammers in the hopes of using those lammers in a future Ten Stix 21™ game. As a more specific example, a Ten Stix 21™ player with less than ten lammers may decide for a number of reasons to leave the table and abandon the game. The player would then be required to return the lammers to the dealer so that they may be used with subsequent players. However, the player may attempt to pocket some of the lammers, thereby returning only the remaining lammers to the dealer. If an overworked, tired, distracted or new dealer does not remember how many lammers had been accumulated by the player, the dishonest player will not likely be revealed or exposed. The player may then keep or transfer those lammers to another player with the intention of surreptitiously adding those extra lammers to that player's total. In essence, an unscrupulous player would count on the inability of a dealer or multiple dealers to keep track of the exact number of lammers distributed to each player over the course of a number of hours, and thus the dishonest player in the above example may only need to accumulate six or seven lammers in one, session, while using the lammers obtained from the prior session, to claim the casino's bonus prize.

The use of the lammers to keep track of each player's bonus points provides a number of opportunities for dishonest players to defeat the purpose of the auxiliary game (i.e., keeping players at the table for extended periods) because such players may illegally transfer or remove the lammers from the gaming table, thereby removing the incentive for such players to stay at the table. Thus, while the use of the lammers allows a conventional blackjack table to be used for a Ten Stix 21™ game with little or no modifications, there is a need for improvements in controlling and scoring the auxiliary game which can be controlled on a reliable basis solely by the dealer and which are not subject to abuse by dishonest players.

It is also to the advantage of the casino to promote the play of the auxiliary game. Promoting the interest of players in playing the auxiliary game has the positive effect of also increasing the play of the primary game, as noted. One of the recognized approaches to promoting games in casinos is to draw attention and fanfare to winners of those games. Such fanfare can take the form of visual and audible announcements of the player's success, such as by lighting displays and sounding bells, tunes and jingles to call attention to the success of the player. Playing the auxiliary game with lammers and awarding the prizes through the dealer makes it difficult to recognize the winning player and announce his or her success to the other players in the general vicinity.

It is with respect to these and other factors that the present invention has evolved.

SUMMARY OF THE INVENTION

One aspect of the present invention allows an auxiliary game to be controlled and scored on a more reliable basis. Another aspect of the improvements available from the present invention relates to assuring the casino that bonus points associated with play of the auxiliary game will be more accurately accounted for and not be surreptitiously transferred by an unscrupulous player to another game. A further aspect of the present invention relates to easing the responsibilities and duties of the dealer in a primary game, when an auxiliary game is played simultaneously with the primary game. Among other aspects of the present invention is the ability to promote the play of the auxiliary game, and indirectly promote the play of the primary game, by creating public displays and recognition associated with awarding prizes to the winners of the auxiliary game.

The auxiliary game according to the invention rewards players' loyalty or fidelity to the principal game and/or the auxiliary game by awarding prizes or pay outs once a player has accumulated a predetermined number of bonus points. Such points may be awarded in addition to other prizes in the auxiliary game. For example, the auxiliary game may offer a chance to win a number of prizes and may include a relatively large prize amount. The rules in the auxiliary game may stipulate that the large prize may be won based on possession of a particularly lucky combination of playing symbols, and a smaller fixed prize is awarded to the faithful player who reaches the predetermined number of bonus points. Similarly, the rules may provide for the opposite, namely smaller prizes can be won directly, while the larger pay outs in the auxiliary game may only be won upon reaching the predetermined number of bonus points. The auxiliary game may require payment to participate, thus allowing for a greater amount of prizes to be awarded. While bonus points may be awarded by receiving a special playing card or matching a playing symbol with a randomly chosen symbol (e.g. selecting a number, color, column etc. in roulette), bonus points may also be awarded by random determination, i.e. a random selector may determine if a player is to be awarded a bonus point. In the auxiliary game, it is possible that some prizes be of greater value, and such greater value may also be awarded by giving more than one bonus point to the winning player.

While the invention provides for better control over an auxiliary game requiring accumulation of bonus points as a condition to be eligible to win a prize, the invention may be configured so as to allow a player to transfer bonus points to another table or player position at a table, to receive a non-zero start up number of bonus points preferably randomly determined), and for a player position to keep the number of bonus points acquired when a player at that position continues to play without paying to participate to in the auxiliary game or when the player is replaced by a new player. When configured in this way, there may be a greater incentive to start to participate in the auxiliary game.

In an auxiliary game requiring payment for participation, leaving bonus points on the player's interface unit when a player leaves the player position does not "cost" the casino, since the bonus points have been directly paid for. If a player decides to leave the table, a by-stander will be enticed to fill the position and take over the bonus points. In the case that players may take bonus points with them, the bonus points may be exchanged for a single value token by the dealer, or the bonus points could be loaded onto a smart card or "Dallas" key for unloading at the new table. The single value token can be exchanged at the new table with the dealer, who will enter tie token value at his or her console. By using single value tokens, players may not combine two tokens to gain a higher trade-in value at another table. By time-stamping the bonus points recorded on the smart card or other monetary value recording medium, the new table could refuse to accept the bonus points if more than a predetermined amount of time has elapsed, for example, the time for a meal break or the time to change tables, or even longer if desired by the casino managers. Instead of reducing the number of stored or saved bonus points to zero when a player exceeds the time limit, it would be possible to reduce the bonus points as a function of time.

As an incentive to join a table, the auxiliary game according to the invention can be configured to award a random number of bonus points. In the case that ten points are required to win a prize in the auxiliary game, the random number may be between zero and five, for example, with a distribution selected by the casino management to be enticing while still profitable to the house. In the latter case, a player, who had little intention of staying at a table long enough to accumulate the desired number of bonus points to win a prize, may be enticed to remain at the casino table to see the benefit of his initial luck in obtaining a relative large number of bonus points.

According to the invention, a player is eligible to win a prize when the predetermined number of bonus points is reached. The auxiliary game according to the invention need not directly and automatically award a prize of fixed or random value when the predetermined number of bonus points is reached. For example, having reached the predetermined number of bonus points may simply make the player eligible to win an enhanced amount of a regular prize or pay out (e.g. double the prize or pay out) either in the principal game or in the auxiliary game. In such a regular pay out or prize multiplier or enhancement configuration, the number of bonus points required to be eligible could also be reduced, for example to five points, and the number of bonus points could be reset when the next one or two bonus points is won. The excitement would thus be increased when the predetermined number of bonus points is reached because the player will be eager to win a prize which qualifies for the loyalty bonus point enhancement while actually hoping not to receive a further bonus point. Likewise, the further bonus point could cancel the enhancement eligibility and also award a smaller bonus prize.

These and other aspects of the present invention are obtained by an electronic system which controls and displays the progress of each player in playing the auxiliary incentive game simultaneously with playing the primary casino table game A bonus point display is positioned for viewing by each player for displaying the number of bonus points received by each player at the gaming table. A controller is connected to the bonus point display and has first means for causing the display to display an incremented number of bonus points received by each player as new bonus points are received by each player, and second means for causing the display to reset and to display a starting number of bonus points in response to the number of bonus points received by the associated player reaching the predetermined number of bonus points. The bonus point display is preferably provided by a player interface unit associated with each player of the primary game and positioned on the gaming table adjacent to the player of the primary game, each player interface unit including a display element to display the number of bonus points received by the associated player, the second means causing the player interface unit to reset the display element to display the starting number of bonus points. Alternatively, the bonus point display may comprises a common display mounted for easy viewing by players at the gaming table, the common display having a display element for each player. Also preferably, the display element is an array of 'n' luminous indicators, where 'n' is the predetermined number of bonus points after which a prize is awarded.

Preferably, a prize display is attached to the gaming table and the prize display includes an indication of at least one prize available to each player who accumulates the predetermined number of bonus points. The controller is connected to the prize display to control the indications of the prize display to show the prize received by each player.

Another embodiment of the invention includes a dealer interface unit connected to the controller and the player interface unit. The dealer interface unit includes dealer control elements which control the bonus points displayed on the player interface units, and which activate a prize selection control element also present on the player interface unit. Upon activation and manipulation of the prize selection control element, the player is able to select one of a plurality of different prizes available for winning the auxiliary game.

An additional embodiment of the invention involves a method of controlling and displaying each player's progress in playing the auxiliary game. The method involves attaching the prize display to the table, indicating on the prize display a plurality of different prizes, selectively lighting the indication of each prize on the prize display, displaying on each player interface unit the number of bonus points received by the player, controlling the number of bonus points displayed on each player interface unit by the dealer manipulating dealer control elements of the dealer interface unit, activating a prize selection element on the player interface unit by the dealer manipulating the dealer control elements, randomly indexing among the different available prizes, and selecting one of the randomly indexed prizes by the player manipulating the player prize selection element.

Additional preferred features of the present invention involve randomly indexing through each of the different prizes and correlating the time instant when the prize selection control element is manipulated to determine the prize awarded; establishing lesser odds for random indexing to each of the more valuable prizes; producing audible sounds when each prize is indicated, when each prize is awarded, and when bonus points are indicated at each player interface unit; and displaying game control information to the dealer at the dealer interface unit which prompts the dealer to manipulate the dealer control elements in accordance with rules of play of the auxiliary game; among others.

A more complete appreciation of the nature, scope and improvements of the present invention can be obtained by reference to the accompanying drawings, which are briefly described below, the following detailed description of presently preferred embodiments of the invention, and the appended claims.

DETAILED DESCRIPTION

Figure 1:
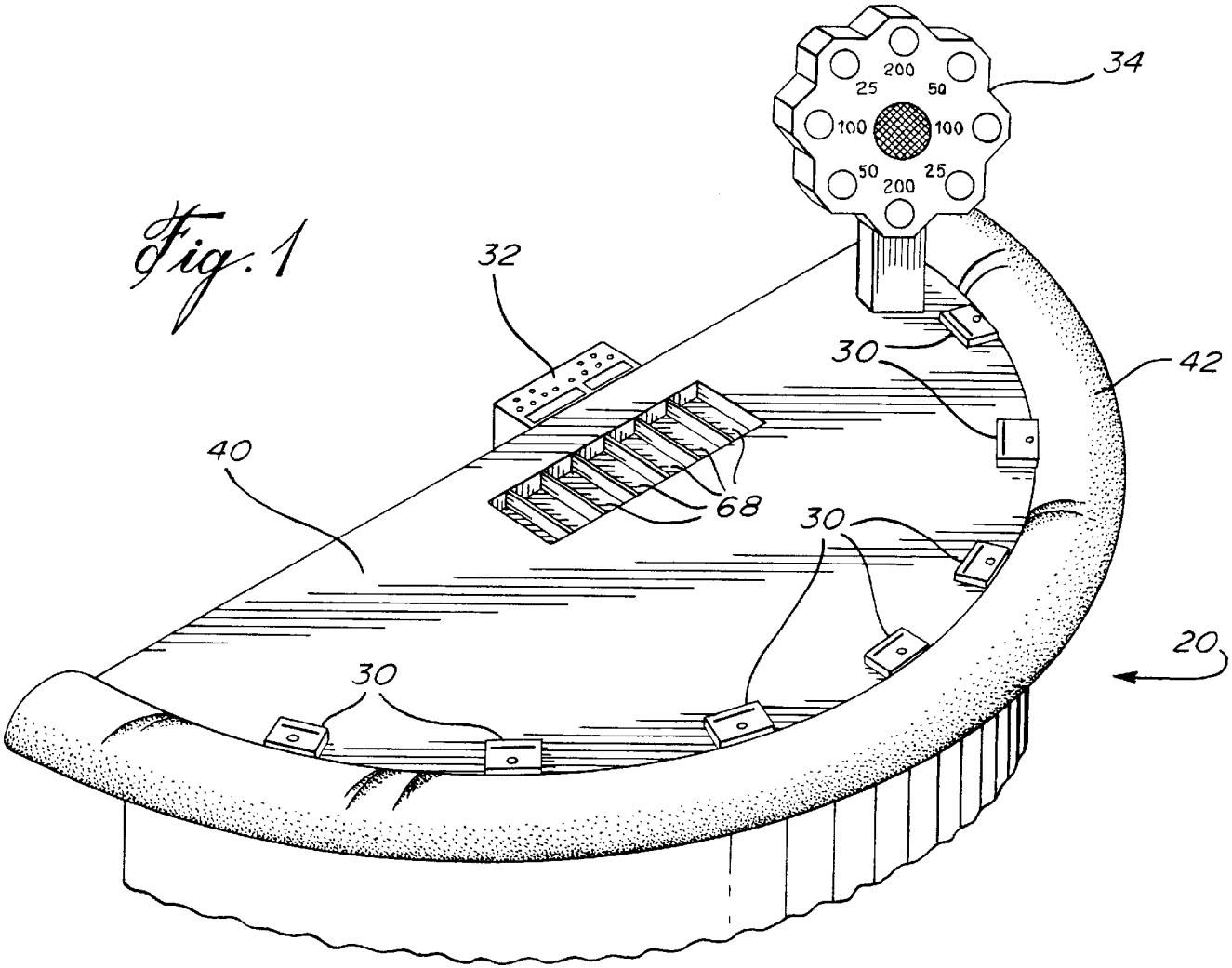
FIG. 1 is a perspective view of a gaming table upon which a primary card game, such as blackjack, is played, and also illustrating an electronic system incorporating the present invention for playing an auxiliary incentive game simultaneously with the primary game.

A conventional casino-type card gaming table 20 upon which both a primary card game and an auxiliary incentive game are played is shown in FIG. 1. While the preferred embodiment of the auxiliary incentive game (specifically Ten Stix 21™ in the preferred embodiment) will be described in conjunction with blackjack as the primary casino table game, it is to be understood that the present invention may be used with a variety of different table games, and card games in particular, where it is desired to encourage players to prolong their play at that table.

An electronic system 22 (FIG. 5) for displaying and controlling each player's progress in the auxiliary game is shown positioned on the table 20. The electronic system 22 preferably comprises four separate and primary components which are electically connected to one another. These four components include a player interface unit 30 (also shown in FIG. 2), a dealer interface unit 32 (also shown in FIG. 3), a prize display 34 (also shown in FIG. 4) and a controller 36 (shown in FIG. 5). The four components 30, 32, 34 and 36 are shown in an interconnected system relationship in FIG. 5. The four components of the system 22 may be added to a conventional gaming table 20 shown in FIG. 1, with a minimum of modifications to the table 20. A separate explanation of each of the four components 30, 32, 34 and 36 is provided below with respect to their use in playing a new and improved version of the Ten Stix 21™ game, which has been developed for use in playing the auxiliary incentive game with the electronic system 22.

Figure 2:
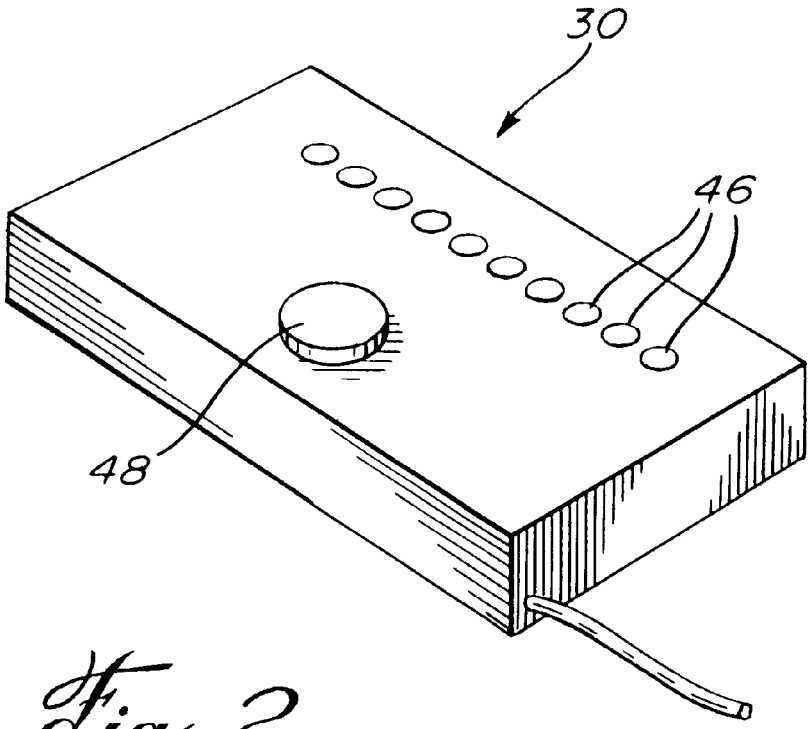
FIG. 2 is an enlarged perspective view of a player interface unit of the auxiliary game playing system shown in FIG. 1.

Each player at the table 20 has his or her own player interface unit 30, as shown in FIGS. 1 and 2. Each player interface unit 30 is supported on or fixed to a playing surface 40 (FIG. 1) of the table 20 adjacent an outer semi-circular railing 42 of the table. While FIG. 1 illustrates seven player interface units 30 arrayed along the railing 42 thus denoting the maximum number of players which may play simultaneously at the table 20, different sized gaming tables may accommodate either a larger or smaller number of the player interface units 30.

Each player interface unit 30 preferably includes ten displays or light emitting diodes (LEDs) 46, as shown in more detail in FIG. 2. While prior versions of Ten Stix 21™ utilized the special chips or lammers to denote the accumulation of bonus points, the LEDs on each player's own interface unit 30 display the number of bonus points accumulated by that player. The bonus point LEDs 46 are individually activated or lighted only by the dealer, using the dealer interface unit 32 (FIG. 1). As noted, the player receives bonus points during the auxiliary Ten Stix 21™ game by trading in the bonus card which the player is dealt during the play of the primary card game. If the player elects to play the bonus card in the play of the primary game, the bonus card is considered as having a predetermined traditional card value, such as a ten card.

The LEDs 46 on the player interface unit 30 are arranged in a row as shown in FIG. 2, although it is within the scope of the present invention to arrange the bonus point LEDs 46 in a different pattern or even to replace the multiple LEDs with a single numerical display which may be incremented by the dealer. Similarly, and depending upon the type of auxiliary game played, the number of bonus point LEDs 46 may be changed from the ten illustrated and described herein.

The bonus point LEDs 46 and the control over lighting the LEDs 46 provides a number of advantages over the prior practice of using physical lammers to denote the accumulation of bonus points. For instance, the LEDs 46 allow both the dealer and the player, as well as spectators and the other players at the table 20, to quickly and accurately assess the number of bonus points which each player has accumulated. More importantly, however, the dealer has the ability to maintain control over the assignment of each player's bonus points. Similarly, when the player elects to cease playing at the table, it is assured that the dealer will collect all of the player's bonus points by simply clearing the display of lighted LEDs 46 from the player interface unit 30, thus preventing unscrupulous players from illegally transferring their bonus points to other players for taking one or more of their bonus points with them when they leave the table 20. Taking as an example a player that has accumulated five bonus points, the system of the present invention represents these five bonus points as five lighted LEDs 46 on that player's interface unit 30. Should that player decide to leave the table 20, the dealer resets the corresponding player interface unit 30 (i.e., deactivates the five lighted LEDs) by use of the dealer interface unit 32. According to the rules of the Ten Stix 21™ game, a new player must start the game with zero bonus points, which is assured because no LEDs 46 are lighted when the new player starts play. Furthermore, because only the dealer may increment the LEDs on each player's interface unit 30, there is no opportunity for players to surreptitiously transfer bonus points to one another. In addition, dealers may be rotated into the game, as is the custom, without having to remember or to communicate information about the number of bonus points accumulated by each player at the table. In essence, these and other advantages are obtained because the bonus points are no longer represented by physical objects such as lammers.

Each player interface unit 30 also includes a prize selection button 48 which must be touched by the player to obtain a prize when the player wins the auxiliary game. The button 48 activates a switch or other control element (not shown). A player wins the auxiliary game once the player receives ten bonus points and all ten bonus point LEDs 46 are lighted. Once a player wins the auxiliary game, the ten lighted LEDs 46 on that player's interface unit 30 preferably begin to flash in unison. Following conclusion of the hand of blackjack or other primary card game in which the player accumulates his or her tenth bonus point, the dealer uses the dealer interface unit 32 to activate the prize selection button 48 on the winning player's interface unit 30. Requiring the player to wait until the button 48 has been activated by the dealer preferably prevents the player from interrupting the flow of the blackjack hand in which the player accumulates his or her tenth bonus point. The activated prize selection button 48 (which may also then be lighted to show that it has been activated) is pressed by the player and a randomly selected prize is awarded to that player.

Activating or touching the prize selection button 48 signals the controller 36 to initiate a random prize selection and award operational sequence. The prize award operational sequence is reflected by visual displays and audible effects from the prize display 34 shown in FIGS. 1 and 4. Additionally, touching the activated prize selection button 48 also causes the controller 36 to reset the corresponding player interface unit 30 by deactivating the ten flashing LEDs 46 as well as turning off the light associated with the prize selection button 48. In this manner, the player interface unit 30 is ready for a subsequent auxiliary game which will start following the award of the random prize.

The prize display 34 preferably contains eight indications and lights 56 indicative of four different prizes (i.e., two indications and lights indicate a single prize each), although the present invention contemplates different numbers of lights and prizes to be accommodated by prize displays 34 of different sizes and configurations. In the example of the prize display 34 shown, the configuration of the prize display is an eight-pointed star, with the lights 56 located in each point 58 of the star configuration. Printed or otherwise displayed on the prize display 34 is the amount of or a description of the prize associated with each light 56. For example, the four prizes shown in FIGS. 1 and 4 on the prize display 34 correspond to different monetary prize values of 25, 50, 100 and 200 dollars. The corresponding values of the four prizes are preferably located at diagonally opposite positions on the eight pointed star, as shown.

Once the activated prize selection button 48 is touched by the winning player, the controller 36 illuminates the lights 56 on the prize display 34, one at a time in a rotational sequence around the points 58. Simultaneously a conventional tone generator (not shown) of the controller 36 generates signals for playing accompanying sound effects from a speaker 60 which is preferably integrated within the prize display 34. Following a predetermined time period during which the rotational sequential illumination of the lights 56 and the sound effects occur, a conventional random number generator of the controller 36 selects one of the prizes. The status of the random number generator is correlated to the instant when the player pushes the prize selection button 48 to establish the prize which is selected and awarded. The controller 36 responds to the random prize selection, and the one of the lights 56 which corresponds to that randomly selected prize is then illuminated continuously or in a flashing manner to indicate the prize. Of course, the rotational sequence of lighting the lights 56 is terminated once the selected prize is announced in this manner. Preferably, the sound effects associated with the rotationally sequential illumination of the lights also cease or change to indicate that the prize has been selected and awarded, such as playing a different musical selection as the single winning light 56 is illuminated continuously or in a flashing manner.

The features of the prize display 34 provide a number of advantages over the prior Ten Stix 21™ game where a single prize was typically awarded to the winner of the auxiliary game. First, by allowing the winning player to press the prize selection button 48 (FIG. 2) and thereby obtain some control, albeit random, over the prize awarded, and by promoting the prize award event with lights and sounds on the prize display 34, the present invention provides a more visceral and rewarding experience for the winning player. The player feels as though he or she is actually participating in the prize selection process. Additionally, the use of the lights 56 and the sound effects on the display 34 will attract the attention of spectators or other players within the casino, which will promote and highlight the fact that players are winning prizes from playing the auxiliary as well as the primary game. Such promotion will presumably enhance the excitement and interest level of all players as well as reinforce the determination of the remaining players at the table to continue playing so they may also receive an auxiliary prize. Furthermore, the casino may offer multiple prizes as opposed to just a single prize, as a result of the random selection capability of the controller. By offering multiple prizes of increasing value, a larger segment of players may also be attracted to playing the games.

While the prize selection may be truly random (i.e., equal odds are assigned to the possibility of winning each of the prizes), the controller 36 also offers the possibility of assigning predetermined different odds for winning each of the prizes. For example, in the preferred embodiment of the present invention, the assigned odds for winning each of the four prizes may be as follows: 1:2 or a 50.00% chance of winning the fourth prize of $25; 1:3 or a 33.34% chance of winning the third prize of $50; 1:8 or a 12.50% chance of winning the second prize of $100; and 1:24 or a 4.16% chance of winning the first prize of $200. Thus, while the controller 36 may still choose a prize at random, the controller 36 may be programmed to constrain its random prize choice according to the above odds.

Figure 3:
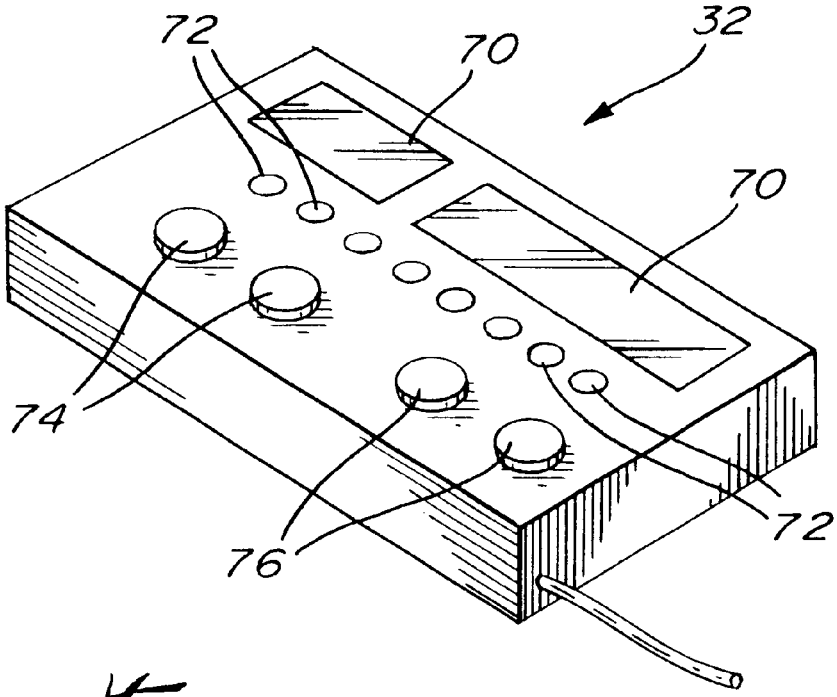
FIG. 3 is an enlarged perspective view of a dealer interface unit of the auxiliary game playing system shown in FIG. 1.
Figure 4:
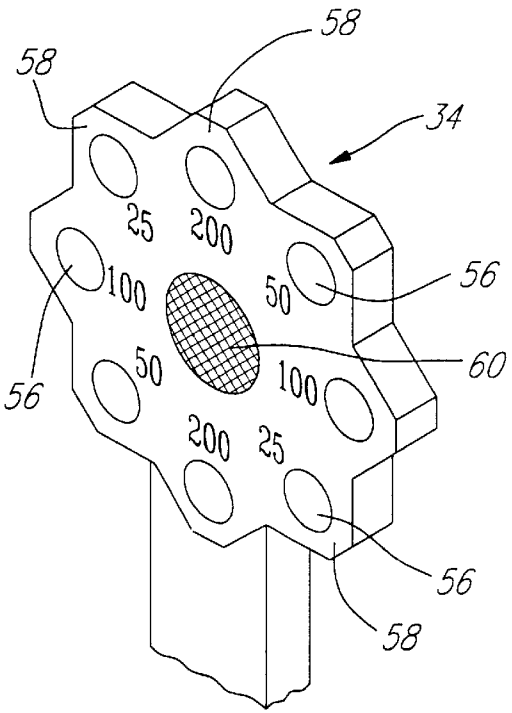
FIG. 4 is an enlarged perspective view of a display of the auxiliary game playing system shown in FIG. 1.

As shown in FIGS. 1 and 3, the dealer interface unit 32 is contained within an enclosure that is attached to or rests on the table 20 adjacent the position where the dealer would normally be standing or seated adjacent to a bank of chip trays 68 of the table 20 The dealer interface unit 32 preferably includes at least one liquid crystal display ("LCD") 70 which displays a menu-driven interface for use in guiding the dealer through the steps necessary to control the system 22. The information presented on the LCD 70 is generated by the controller 36. The dealer interface unit 32 also preferably includes a series of player position or player number buttons 72. The buttons 72 activate switches on other control elements (not shown) to signal the controller 36. Thus, in the preferred example described herein where the table 20 accommodates seven players, the dealer interface unit 32 contains at least seven consecutive player number buttons 72. The player number buttons 72 are preferably numbered or are physically located to correspond to, and indicate each of, the players and player positions around the table. The player number buttons 72 are used by the dealer to select the player interface unit 30 for lighting the bonus point LEDs 46 and to activate the prize selection buttons 48.

The dealer interface unit 32 preferably includes a bonus point AWARD button 74 which the dealer touches to award a single LED or bonus point to a player. Once the dealer touches the bonus point AWARD button 74, the controller 36 is signaled and the next one of the bonus point LEDs 46 of the player selected is lighted. The dealer interface unit 32 also includes an AWARD PRIZE button 76 which the dealer touches once a player has accumulated ten bonus points or ten LEDs 46 on his or her interface unit 30. The accumulation of ten bonus points and lighted LEDs 46 will be recognized by the controller 36, and the tenth lighted LED 46 will cause the winning player's LEDs 46 to flash on his or her interface unit 30. However, that player's prize selection button 48 will not automatically be activated due to a desire to allow the dealer to conclude the current hand of cards in the primary game before providing the winning player an opportunity to select his or her prize from the auxiliary game. Once the dealer concludes the primary game hands the dealer then touches the AWARD PRIZE button 76 to initiate the prize awarding sequence. Once the appropriate player number button 72 is selected by the dealer, that player may press the prize selection button 48 at his or her interface unit 30 to initiate the above-described random prize selection process. The buttons 74 and 76 activate switches or other control elements (not shown) to signal the controller 36.

Although the dealer preferably touches the player number button 72 to identify and determine the player to whom bonus points and game awards will be assigned by the dealer's subsequent touching of the bonus point AWARD and AWARD PRIZE buttons, the reverse may also occur, depending on the control sequence established by the controller 36. For example, the dealer could touch the bonus point AWARD button 74, and the controller could query the dealer with a display at the LCD 70 asking which player should be awarded the bonus point. In this circumstance, the dealer would respond by touching one of the player number buttons 72 corresponding to the player to whom the bonus point is to be awarded. A similar sequence could be followed with respect to the AWARD PRIZE button 76, before the dealer could award the auxiliary game prize to the winning player. The logical condition of requiring ten lighted LEDs 46 from the player interface unit 30 to be determined by the controller 36 can also safeguard the correct activation of the AWARD PRIZE button for the winning player. Once the appropriate player number button 72 is selected by the dealer, that player may press the prize selection button 48 (FIG. 2) at his or her interface unit 30 to initiate the above-described random prize selection process. In general however, the LCD 70 at the dealer interface unit 32 provides the possibility of communicating information directly to the dealer from the controller 36, as may be necessary or desirable to achieve efficient and correct play of the auxiliary game.

The LCD 70 may display the selected player number or position, the number of bonus point awards of each player, the length of time of play by each player, and a variety of other information which may be directly relevant or only peripherally of interest to the play of the auxiliary game.

Figure 5:
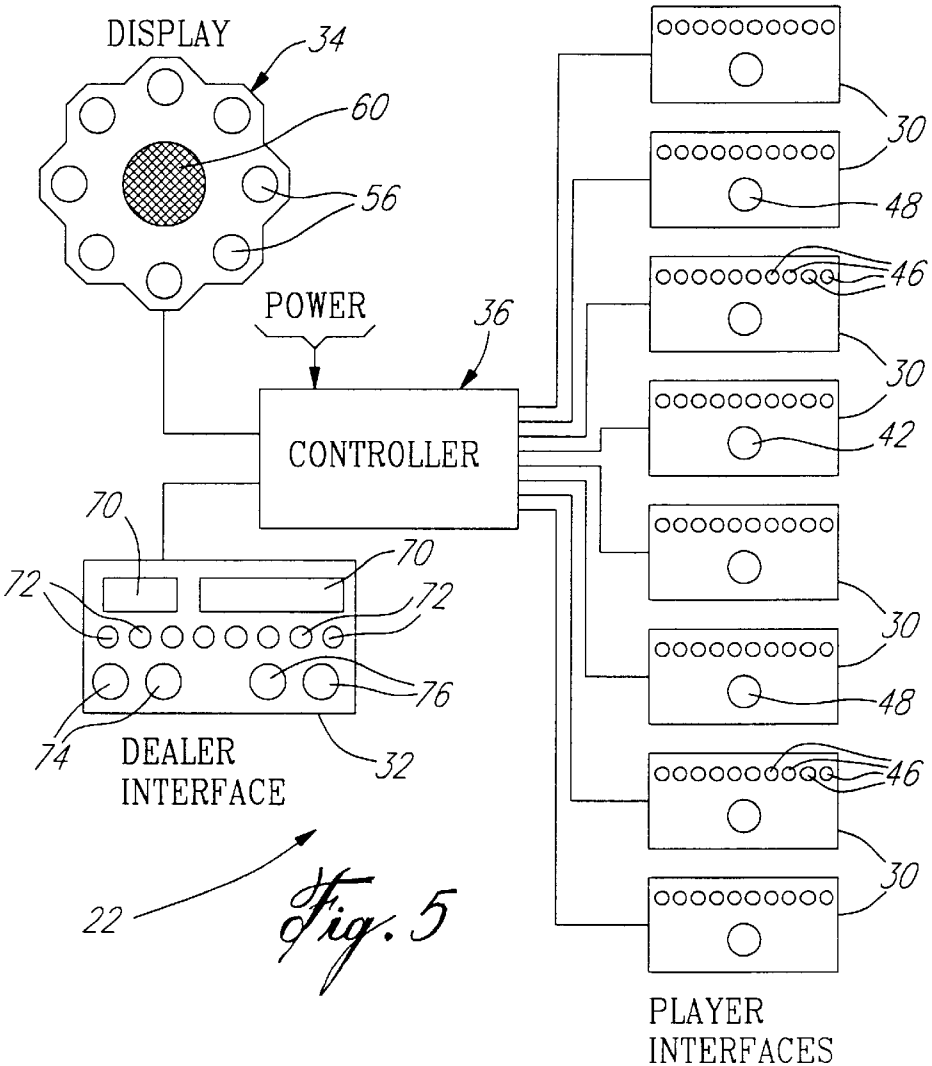
FIG. 5 is a block diagram of the elements of the auxiliary game playing system shown in FIGS. 1–4.

The controller 36 of the system 22 shown in FIG. 5 is preferably implemented by a conventional microprocessor or microcontroller (not specifically shown) which has been programmed to perform the functions described above, and possibly additional functions not directly relevant to the present invention. Programming the microprocessor or microcontroller will be accomplished by recording in its memory those functions and logical constraints necessary to achieve play of the auxiliary game as described. In addition, conventional logic circuits and logic elements, in addition to the conventional tone and random number generators described above, may be employed to accomplish and determine the logical conditions and constraints involved in playing the auxiliary game. Such logic circuits and other elements might be implemented separately from the microcontroller or microprocessor but, for convenience of illustration, FIG. 5 shows all of these operational elements grouped together as the single controller 36.

Preferably, the controller 36 will also include a non-volatile memory containing information defining the basic instructions for the microcontroller or microprocessor. Electrically programmable read only memories may be advantageously employed for this purpose. Use of non-volatile memory in this matter eliminates the necessity for batteries and other separate power supplies to be included as part of the controller 36.

The functional components of the controller 36 are also preferably contained within a single enclosure, and this single enclosure may be conveniently attached to the bottom of the table 20 or in some other location on the table which does not interfere with or become apparent to the players, thereby avoiding additional distractions and changes from the conventional layout of a casino-type card table 20. Power from a conventional AC source such as a wall outlet is preferably supplied directly to the controller 36. The controller 36 also includes the necessary power supply elements to convert standard electrical power into the levels necessary to power the components of the system 22. The player and dealer interface units are electrically connected to the controller 36 by single multi-conductor cables. The multi-conductor cables supply electrical power to the interface units and also conduct the control signals caused by depressing or touching the buttons (which result in switch closures) as described, as well as conducting the energizing signals to the display lights, LEDs, LCD and speaker. As a result, only a minimum of wires need to be routed within the table 20, and separate power cords do not have to be attached to each of the elements. Preferably, the player interface units are positioned adjacent to the table railing 42 (FIG. 1), and the single multi-wire cable is routed directly under the railing 42 without becoming obtrusive on the table. Only a minimum amount of modifications are therefore required to convert a standard blackjack or other casino-type card table to a table capable of supporting play of the auxiliary game according to the present invention.

As can be appreciated from the foregoing description, the present invention provides a number of benefits over prior Ten Stix 21™ games, and a number of improvements for playing an auxiliary game simultaneously with a primary card game. First, the use of an electronic player interface 30 allows bonus points to be awarded by intangible LED displays as opposed to tangible lammers or chips, and this intangible bonus point award prevents unscrupulous players from transferring some or all of his or her bonus points to a different game or player. Therefore, the electronic version of the Ten Stix 21™ game accomplishes the purpose of enticing players to stay for extended periods of time at the gaming table while not providing any extra reward to players who do not stay for sufficient periods of time to complete or win the auxiliary game. The use of the electronic prize display 34 with its visual and audible effects adds a level of excitement and entertainment to the game and further helps to promote and advertise the game to other players. Also, by providing an opportunity for winners to pro-actively select their own random prize, by pressing the prize selection button 48 to initiate the random drawing, the auxiliary game may appeal to more players. Lastly, the use of a random prize generator allows casinos to offer a variety of prizes as opposed to just one standard prize, and this may attract a larger number of players, even if the controller 34 is programmed to increase the odds that a player will win the lesser valued prizes.

Figure 6:
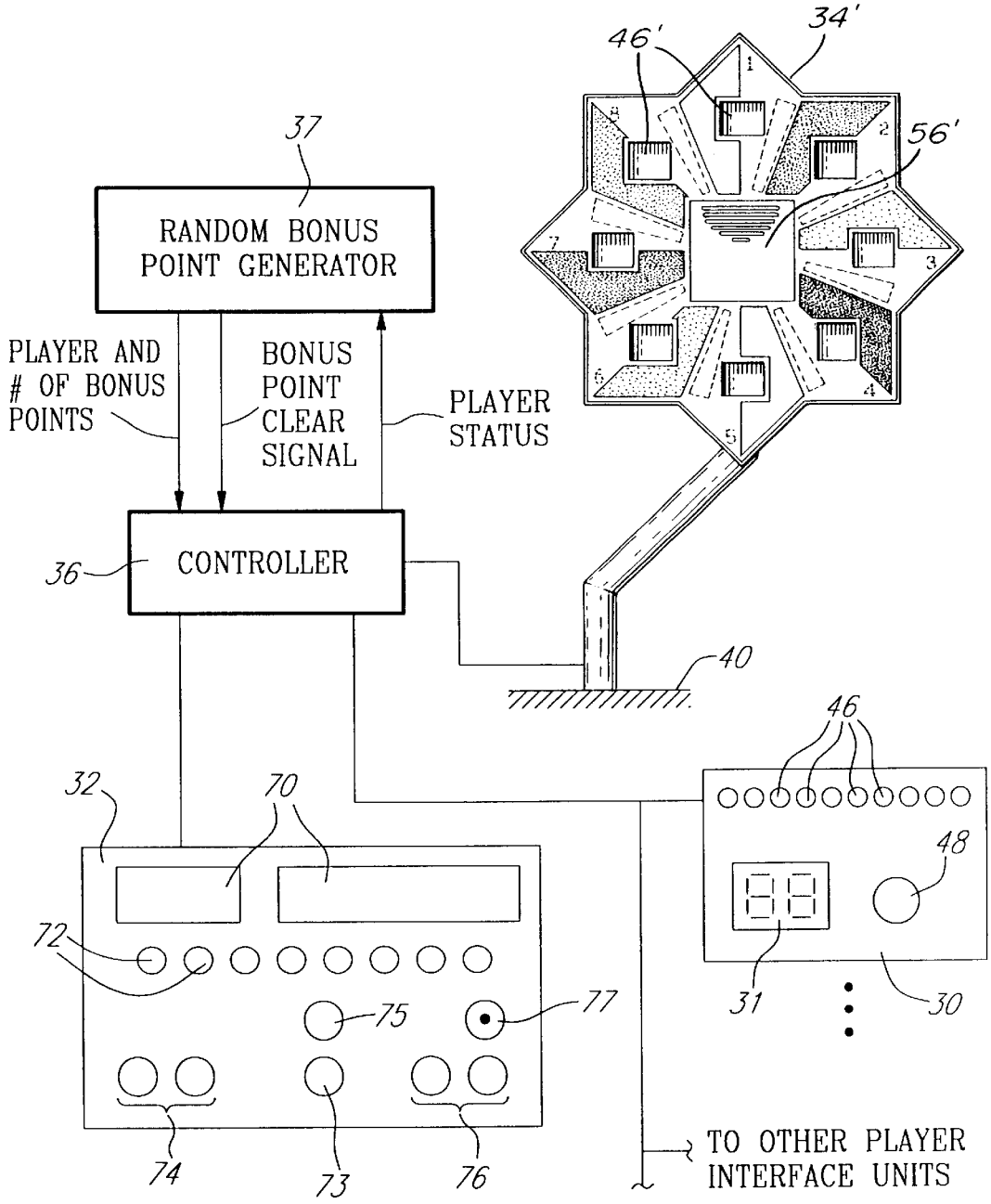
FIG. 6 is a block diagram of the elements of the auxiliary game playing system according to an alternative embodiment of the invention.

FIG. 6 illustrates an alternative embodiment of the invention in which the bonus point display 46 is provided on a common table mounted display 34' including eight individual numerical displays 46' associated with each of the player positions. A prize amount display 56' is provided centrally on display 34'. In the alternative embodiment, players pay to participate in the auxiliary game. Each player wishing to participate in the auxiliary game pays to the dealer using abetting token or chip an amount which the dealer receives and then credits to the player's account by pressing the credit key 75, selecting the corresponding amount using up/down keys (e.g. 74) and then pressing the player key 72. The controller then sends a credit signal to player's interface 30 to display the amount paid for on a numerical display 31. When the display 31 is decremented with each play to zero, the player no longer participates in the auxiliary game, and thus the player must pay the dealer to supplement his credits.

In the alternative embodiment, a player who participates in the auxiliary may win prizes in the auxiliary game aside from the bonus prize which is won when the predetermined number of bonus points have been accumulated. A random bonus point generator 37 is also provided to make the auxiliary incentive game more exciting, and to attract attention to the auxiliary game among those who are not participating. The random generator 37 may give points to non-participating players, i.e. either to vacant player positions or to occupied player positions where the player has opted not to play the auxiliary game. The latter case requires the controller to receive additional input to know which positions are occupied by players who are not playing the auxiliary game, since the controller 36 only knows directly which players are paying to playing in the auxiliary. The dealer can provide such input by pressing an "in play" key (not shown) and then the player position key 72 for the player. The random bonus point generator 37 may "tease" non-participating players by randomly awarding one or more bonus points. The bonus points may accumulate and provide a strong incentive to join in the auxiliary game. The generator 37 may also randomly select to "wipe out" tie bonus points accumulated at a non-participating player position so as to provide the additional incentive to join in the auxiliary game resulting from the "free" bonus points being a "limited time offer". Similarly, the generator 37 may operate to provide random bonus points to player positions where no player is playing even in the principal game. By-standers are thus attracted to the display 46 and 46' of bonus points to join in the principal and auxiliary game at the particular player position. Delay in joining in may result, of course, in the incentive being wiped out The starting amount of bonus points may also be determined by random generator 37 in the case that amounts from previous players may not be left behind and "teaser" amounts are not used. The generator 37 may also be used simply to provide participating auxiliary game players with extra bonus points.

When a player leaves the gaming table 40, the house rules may prevent the player from taking bonus points with him or her, as is the case in the preferred embodiment. In the alternative embodiment, however, the player may take bonus points to a new gaming table or leave them behind for the next player. A player may take points by asking the dealer to take his or her Dallas™ key or smart card type button and load onto the key his or her bonus point credits. The dealer panel 32 has a key interface 77 and a transfer button 73 for this purpose. The dealer touches the key on interface 77, presses the transfer key 73 and then the player position key 72. The controller 36 confirms the validity of the key, and loads onto the key the bonus points with a time stamps and authorization code. When the player goes to another table, the key is given to the dealer where it is touched on the interface 77. The data on the key is verified to make sure the time stamp and authorization code are valid and that the player may transfer the points under house rules. The dealer then presses the player position key 72 to transfer the points to the new player at the new table. When a smart key or card is not used, special tokens may be given to players wishing to move between tables, however, it is very desirable that such tokens have every exact amount (i.e. 1,2,3,4,5,6,7,8 and 9 points) to prevent players from every being able to combine two such tokens to start at a new table with bonus points closer to the predetermined number to win a prize.

The presently preferred embodiment of the invention, its improvements and the alternative embodiment have been described with a degree of particularity. This description has been made by way of preferred example. It should be understood that the scope of the present invention is defined by the following claims, and should not necessarily be limited by the detailed description of the preferred embodiment set forth above.

What is claim is:

1. A system for controlling and displaying each player's progress in an auxiliary incentive game played simultaneously with a principal or primary casino table game directed by a dealer or croupier and played on a gaming table, the auxiliary game involving each player receiving bonus points during the course of playing the primary game and each player being eligible to receive a prize only after accumulating a predetermined number of bonus points, said system comprising:

a bonus point display for displaying the number of bonus points received by each player at the gaming table;

a controller connected to the bonus point display, and having first means for causing the display to display an incremented number of bonus points received by each player as new bonus points are received by each player, and second means for causing the display to reset and to display a starting number of bonus points in response to the number of bonus points received by the associated player reaching the predetermined number of bonus points; and means associated with the controller for receiving bonus points from another gaming table.

2. A system as defined in claim 1, wherein the bonus point display comprises a player interface unit associated with each player of the primary game and positioned on the gaming table adjacent to the player of the primary game, each player interface unit including a display element to display the number of bonus points received by the associated player, the second means causing the player interface unit to reset the display element to display the starting number of bonus points.

3. A system as defined in claim 1, wherein the bonus point display comprises a common display mounted for easy viewing by players at the gaming table, the common display having a display element for each player.

4. A system as defined in claim 2, wherein the display element comprises an array of 'n' luminous indicators, where 'n' is the predetermined number of bonus points after which a prize is awarded.

5. A system as defined in claim 1, further comprising:

a player participation indicator for providing an indication of whether each player of the primary game has paid an additional wager to participate in the auxiliary game.

6. A system as defined in claim 1, wherein:

the gaming table has predetermined player positions and the bonus point display has display elements associated with each one of the player positions;

the controller awards randomly selected bonus points to the player positions when no player is playing at the player positions;

a random bonus point generator means randomly also generates a bonus point clear signal; and the controller subtracts one of none, one, some and all of the bonus points accumulated by the player positions when no player is playing at the player positions.

7. A system as defined in claim 1, wherein:

the gaming table has predetermined player positions and the bonus point display has display elements associated with each one of the player positions, the controller awards randomly selected bonus points to the player positions when the player playing at the player position has not paid to participate in the auxiliary game;

a random bonus point generator means randomly also generates a bonus point clear signal; and the controller subtracts one of none, one, some and all of the bonus points accumulated by the player positions when the player playing at the player position has not paid to participate in the auxiliary game.

8. A system as defined in claim 1, further comprising:

means for resetting the bonus point display when the associated player leaves the gaming table.

9. A system as defined in claim 8, further comprising a start-up bonus point generator for randomly determining the start-up number of bonus points displayed on the bonus point display for a new player starting to play at the gaming table.

10. A system s defined in claim 1, wherein the controller comprises a monetary value recording medium reader for receiving bonus points from another gaming table.

11. A system as defined in claim 1, wherein the controller comprises dealer input means for entering a value of bonus points for a player in exchange for a like value bonus point token.

12. A system as defined in claim 2, further comprising:

a prize display including an indication of at least one prize available to each player who accumulates the predetermined number of bonus points, the prize display including at least one light omitting element associated with each indication, the controller being connected to the prize display and further comprising third means for controlling the light emitting elements associated with the indications on the prize display to indicate the prize received by each player.

13. A system as defined in claim 12, further comprising:

a dealer interface unit associated with the dealer of the primary game and positioned on the table adjacent to the dealer, the dealer interface unit including dealer control elements for signaling the controller to display bonus points on the bonus point display.

14. A system as defined in claim 13, wherein:

the player interface unit further comprises a player control element manipulated by the associated player to select the prize.

15. A system as defined in claim 14, wherein:

the dealer control elements of the dealer interface twit also signal the controller to activate the player control element at the player interface unit associated with the player who has accumulated the predetermined number of bonus points; and the player control element used by the player to select the prize is activated at the player interface unit by the controller in response to a signal from the dealer control elements of the dealer interface unit.

16. A system as defined in claim 15, wherein:

the controller further determines when each player has received the predetermined number of bonus points which entitles the player to select the prize; and the player control element used by the player to select the prize is activated by the controller upon determining that the player has received the predetermined number of bonus points and upon signaling from the dealer control elements.

17. A system as defined in claim 14, wherein:

the prize display includes indications of a plurality of different prizes available to each player who accumulates the predetermined number of bonus points; and the controller randomly selects one of the plurality of difference prizes in response to the manipulation of the activated player control element of the player interface unit by the associated player.

18. A system as defined in claim 17, wherein: the controller includes a random generator;

the controller causes the random, generator to select each of the prizes on a random basis; and the manipulation of the player control element by the associated player signals the random generator to select one of the prizes.

19. A system as defined in claim 18, wherein:

the random generator indexes through each of the different prizes on a random basis; and the time instant when the player control element is manipulated is correlated to the one of the prizes which is indexed by the random generator.

20. A system as defined in claim 18, wherein the controller establishes different odds for the random generator to select each of the prizes.

21. A system as defined in claim 20, wherein: each of the different prizes has a different value; and the controller establishes lesser odds for selecting the greater valued prizes.

22. A system as defined in claim 17, wherein:

the prize display includes a separate indication for each of the different prizes; and the controller signals the prize display to light the light emitting element of each indication of each prize immediately prior to the selection of the prize resulting from the associated player manipulating the player control element of the player interface unit.

23. A system as defined in claim 22, wherein:

the controller signals the prize display to light the light emitting element of each prize indication in a predetermined sequence.

24. A system as defined in claim 22, wherein:

the indications of each prize are positioned on the prize display in a predetermined pattern capable of exhibiting a sequence; and the predetermined sequence of lighting the light emitting elements of each prize indication is correlated to the predetermined pattern of indications on the prize display.

25. A system as defined in claim 24, wherein: the predetermined pattern is a rotational figure; and the predetermined sequence is a rotational sequence around the rotational figure pattern of indications.

26. A system as defined in claim 23, further including: a speaker connected to the controller; and wherein:

the controller further includes a tone generator connected to the speaker and operative to produce a predetermined audible sound from the speaker during lighting the light emitting elements of each prize indication.

27. A system as defined in claim 13, wherein:

the dealer interface unit includes a display for displaying game control information to the dealer; and the controller signals the display of the dealer interface unit to display information instructing the dealer how to manipulate the dealer control elements.

28. A system as defined in claim 12, further including: a speaker connected to the controller; and wherein:

the controller further includes a tone generator connected to the speaker and operative to produce a predetermined audible sound from the speaker during lighting of the light emitting elements of the prize indications prior to selection of the prize.

29. A system as defined in claim 28, wherein:

the controller controls the tone generator to produce an audible sound from the speaker when a bonus point is displayed at each player interface unit.

30. A system for controlling and displaying each player's progress in an auxiliary incentive game played simultaneously with a principal or primary casino table game directed by a dealer or croupier and played on a gaming table, the auxiliary game involving each player receiving bonus points during the course of playing the primary game and each player being eligible to receive a prize only after accumulating a predetermined number of bonus points, said system comprising:

a bonus point display for displaying the number of bonus points received by each player at the gaming table;

a controller connected to the bonus point display and having first means for causing the display to display an incremented number of bonus points received by each player as new bonus points are received by each player, and second means for causing the display to reset and to display a starting number of bonus points in response to the number of bonus points received by the associated player reaching the predetermined number of bonus points;

means for resetting the bonus point display when the associated player leaves the gaming table; and a start-up bonus point generator for randomly determining the start-up number of bonus points displayed on the bonus point display for a new player starting to play at the gaming table.

31. A system as defined in claim 30, wherein the bonus point display comprises a player interface unit associated with each player of the primary game and positioned on the gaming table adjacent to the player of the primary game, each player interface unit including a display element to display the number of bonus points received by the associated player, the second means causing the player interface unit to reset the display element to display the starting number of bonus points.

32. A system as defined in claim 30, wherein the bonus point display comprises a common display mounted for easy viewing by players at the gaming table, the common display having a display element for each player.

33. A system as defined in claim 31, wherein the display element comprises an array of 'n' luminous indicators, where 'n' is the predetermined number of bonus points after which a prize is awarded.

34. A system as defined in any one of claim 30, further comprising:

a player participation indicator for providing an indication of whether each player of the primary game has paid an additional wager to participate in the auxiliary game.

35. A system as defined in claim 30, wherein:

the gaming table has predetermined player positions and the bonus point display has display elements associated with each one of the player positions;

the controller awards randomly selected bonus points to the player positions when no player is playing at the player positions;

a random bonus point generator means randomly also generates a bonus point clear signal; and the controller subtracts one of none, one, some and all of the bonus points accumulated by the player positions when no player is playing at the player positions.

36. A system as defined in claim 30, wherein:

the gaming table has predetermined player positions and the bonus point display has display elements associated with each one of the player positions;

the controller awards randomly selected bonus points to the player positions when the player playing at the player position has not paid to participate in the auxiliary game;

a random bonus point generator means randomly also generates a bonus point clear signal; and the controller subtracts one of none, one, some and all of the bonus points accumulated by the player positions when the player playing at the player position has not paid to participate in the auxiliary game.

37. A system as defined in any one of claim 30, further comprising:

means associated with the controller for receiving bonus points from another gaming table.

38. A system s defined in claim 37, wherein the controller comprises a monetary value recording medium reader for receiving bonus points from another gaming table.

39. A system as defined in claim 37, wherein the controller comprises dealer input means for entering a value of bonus points for a player in exchange for a like value bonus point token.

40. A system as defined in claim 31, further comprising:

a prize display including an indication of at least one prize available to each player who accumulates the predetermined number of bonus points, the prize display including at least one light emitting element associated with each indication, the controller being connected to the prize display and further comprising third means for controlling the light emitting elements associated with the indications on the prize display to indicate the prize received by each player.

41. A system as defined in claim 40, further comprising:

a dealer interface unit associated with the dealer or the primary game and positioned on the table adjacent to the dealer the, dealer interface unit including dealer control elements for signaling the controller to display bonus points on the bonus point display.

42. A system as defined in claim 41, wherein:

the player interface unit further comprises a player control element manipulated by the associated player to select the prize.

43. A system as defined in claim 42, wherein:

the dealer control elements of the dealer interface unit also signal the controller to activate the player control element at the player interface unit associated with the player who has accumulated the predetermined number of bonus points; and the player control element used by the player to select the prize is activated at the player interface unit by the controller in response to a signal from the dealer control elements of the dealer interface unit.

44. A system as defined in claim 43, wherein:

the controller further determines when each player has received the predetermined number of bonus points which entitles the player to select the prize; and the player control element used by the player to select the prize is activated by the controller upon determining that the player has received the predetermined number of bonus points and upon signaling from the dealer control elements.

45. A system as defined in claim 42, wherein:

the prize display includes indications of a plurality of different prizes available to each player who accumulates the predetermined number of bonus points; and the controller randomly selects one of the plurality of difference prizes in response to the manipulation of the activated player control element of the player interface unit by the associated player.

46. A system as defined in claim 45, wherein: the controller includes a random generator;

the controller causes the random generator to select each of the prizes on a random basis; and the manipulation of the player control element by the associated player signals the random generator to select one of the prizes.

47. A system as defined in claim 46, wherein:

the random generator indexes through each of the different prizes on a random basis; and the time instant when the player control element is manipulated is correlated to the one of the prizes which is indexed by the random generator.

48. A system as defined in claim 46, wherein the controller establishes different odds for the random generator to select each of the prizes.

49. A system as defined in claim 48, wherein: each of the different prizes has a different value; and the controller establishes lesser odds for selecting the greater valued prizes.

50. A system as defined in claim 45, wherein:

the prize display includes a separate indication for each of the different prizes; and the controller signals the prize display to light the light emitting element of each indication of each prize immediately prior to the selection of the prize resulting from the associated player manipulating the player control element of the player interface unit.

51. A system as defined in claim 50, wherein:

the controller signals the prize display to light the light emitting element of each prize indication in a predetermined sequence.

52. A system as defined in claim 51, wherein:

the indications of each prize are positioned on the prize display in a predetermined pattern capable of exhibiting a sequence; and the predetermined sequence of lighting the light emitting elements of each prize indication is correlated to the predetermined pattern of indications on the prize display.

53. A system as defined in claim 52, wherein: the predetermined pattern is a rotational figure; and the predetermined sequence is a rotational sequence around the rotational figure pattern of indications.

54. A system as defined in claim 51, further including: a speaker connected to the controller; and wherein:

the controller further includes a tone generator connected to the speaker and operative to produce a predetermined audible sound from the speaker during lighting the light emitting elements of each prize indication.

55. A system as defined in claim 41, wherein:

the dealer interface unit includes a display for displaying game control information to the dealer; and the controller signals the display of the dealer interface unit to display information instructing the dealer how to manipulate the dealer control elements.

56. A system as defined in claim 40, further including: a speaker connected to the controller; and wherein:

the controller further includes a tone generator connected to the speaker and operative to produce a predetermined audible sound from the speaker during lighting of the light emitting elements of the prize indications prior to selection of the prize.

57. A system as defined in claim 56, wherein:

the controller controls the tone generator to produce an audible sound from the speaker when a bonus point is displayed at each player interface unit.

* * * * *

UNITED STATES PATENT AND TRADEMARK OFFICE

CERTIFICATE OF CORRECTION

PATENT NO. : 6,638,167 B1
DATED : October 28, 2003
INVENTOR(S) : Sawyer et al.

It is certified that error appears in the above-identified patent and that said Letters Patent is hereby corrected as shown below:

Column 15,
Line 28, change “positions,” to -- positions; --;
Line 48, change “s” to -- as --;
Line 58, delete the comma;

Column 16,
Line 9, change “twit” to -- unit --;
Lines 35 and 51, after “wherein:” insert a new line;

Column 17,
Line 9, after “wherein:” insert a new line;
Line 13, delete the colon;
Line 14, change “controller; and wherein:” to -- controller, wherein --;
Line 26, delete the colon;
Line 27, change “controller; and wherein:” to -- controller, wherein --;

Column 18,
Line 14, delete “any one of”;
Line 51, change “s” to -- as --;

Column 19,
Line 1, change “dealer the,” to -- dealer, the --;

UNITED STATES PATENT AND TRADEMARK OFFICE

CERTIFICATE OF CORRECTION

PATENT NO. : 6,638,167 B1
DATED : October 28, 2003
INVENTOR(S) : Sawyer et al.

It is certified that error appears in the above-identified patent and that said Letters Patent is hereby corrected as shown below:

Column 20,
Line 1, delete the colon;
Line 26, after "wherein:", insert a new line.
Line 30, delete the colon;
Line 31, change "controller; and wherein:" to -- controller, wherein --.

Signed and Sealed this

Twenty-first Day of September, 2004

JON W. DUDAS
*Director of the United States Patent and Trademark Office*

UNITED STATES PATENT AND TRADEMARK OFFICE

CERTIFICATE OF CORRECTION

PATENT NO. : 6,638,167 B1
DATED : October 28, 2003
INVENTOR(S) : Sawyer et al.

It is certified that error appears in the above-identified patent and that said Letters Patent is hereby corrected as shown below:

Column 3,
Line 29, change “then turned” to -- then returned --;

Column 7,
Line 54, add -- (FIG. 1) -- after “on the table”;

Column 10,
Line 53, add a period after “table 20”;

Column 13,
Line 20, replace “abetting” by -- a betting --;

Column 15,
Line 59, replace “omitting” by -- emitting --;

Column 16,
Line 37, delete the comma between “random” and “generator”;

Column 18,
Line 47, delete “any one of” before “claim 30”;

Column 19,
Line 37, replace “difference prizes” by -- different prizes --.

Signed and Sealed this

Twenty-sixth Day of October, 2004

JON W. DUDAS
*Director of the United States Patent and Trademark Office*